US008472859B2

(12) United States Patent
Kougami

(10) Patent No.: US 8,472,859 B2
(45) Date of Patent: Jun. 25, 2013

(54) PAPER SHEET HUMIDIFYING DEVICE, PAPER SHEET POST-PROCESSING APPARATUS AND IMAGE FORMING SYSTEM

(75) Inventor: Masashi Kougami, Saitama (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 258 days.

(21) Appl. No.: 12/949,483

(22) Filed: Nov. 18, 2010

(65) Prior Publication Data

US 2011/0121086 A1 May 26, 2011

(30) Foreign Application Priority Data

Nov. 26, 2009 (JP) ..... 2009-268558

(51) Int. Cl.
*G03G 15/00* (2006.01)

(52) U.S. Cl.
USPC ..... 399/407; 399/341; 399/390

(58) Field of Classification Search
USPC ..... 399/407, 341, 390
See application file for complete search history.

(56) References Cited

U.S. PATENT DOCUMENTS 6,249,655 B1 * 6/2001 Baek et al. ..... 399/12
6,352,379 B2 * 3/2002 Sanada ..... 396/575
7,840,173 B2 * 11/2010 Kougami et al. ..... 399/406
2008/0089728 A1 4/2008 Kougami et al.
2008/0148750 A1 * 6/2008 Hsu ..... 62/188
2008/0298843 A1 * 12/2008 Hobo et al. ..... 399/238
2008/0317447 A1 * 12/2008 Lentz et al. ..... 392/326
2010/0000269 A1 * 1/2010 Shin et al. ..... 68/5 C
2010/0052921 A1 * 3/2010 Cantolino ..... 340/620

FOREIGN PATENT DOCUMENTS

JP 2006-008282 A 1/2006
JP 2008-094585 A 4/2008

* cited by examiner

*Primary Examiner* — Matthew G Marini
*Assistant Examiner* — Allister Primo
(74) *Attorney, Agent, or Firm* — Holtz, Holtz, Goodman & Chick, P.C.

(57) ABSTRACT

A paper sheet humidifying device including a humidifying roller to convey a paper sheet and apply water to the paper sheet; a water supply roller to supply water to the humidifying roller; a water supply plate to contain the water for dipping the water supply roller, and to eject excessive water by overflowing; a water feeding section to feed the water to the water supply plate; a drain tank to receive the water ejected from the water supply plate, the drain tank comprising a drain outlet to eject the received water; a water level sensor to output a signal when a water level in the drain tank reaches a prescribed level; and a controller to execute a control to prevent overflowing of the water from the drain tank based on the signal from the water level sensor.

6 Claims, 8 Drawing Sheets

PAPER SHEET HUMIDIFYING DEVICE, PAPER SHEET POST-PROCESSING APPARATUS AND IMAGE FORMING SYSTEM

CROSS REFERENCE TO RELATED APPLICATION

The present application is based on Japanese Patent Application No. 2009-268558 filed with Japanese Patent Office on Nov. 26, 2009, the entire content of which is hereby incorporated by reference.

BACKGROUND OF THE INVENTION

1. Technical Field

The present invention relates to a paper sheet humidifying device to straighten paper sheets by applying water to the paper sheets to remove curvatures, undulations, waves and the like; a paper sheet post-processing apparatus built-in with the paper sheet humidifying device; and an image forming system built-in with the paper sheet humidifying device.

2. Background Technology

As a paper sheet post-processing apparatus of an electrophotographic image forming apparatus, a paper sheet humidifying device for humidifying the paper is utilized.

Among various types of the proposed paper sheet humidifying devices, a paper sheet humidifying device provided with a pair of humidifying rollers for applying water to the paper sheet and water supply rollers for supplying water to the pair of humidifying rollers is disclosed in Japanese Patent Application Publication No. 2006-8282 (Patent document 1) and in Japanese Patent Application Publication No. 2008-94585 (Patent document 2).

In the paper sheet humidifying device of Patent document 1, a water supply roller continuously supplies water to the pair of humidifying rollers, and the humidifying rollers continuously humidify the paper sheet being conveyed.

The water supply roller in the Patent document 1 is dipped in the water contained in a container, and continuously scoops up the water by being rotated.

In the paper sheet humidifying device of Patent document 2, a pair of water supply rollers respectively contact the pair of humidifying rollers, and supply the water to the humidifying rollers.

The pair of water supply rollers in the Patent document 2 is dipped in the water contained in a water supply plate, and continuously scoops up the water by being rotated.

According to the Patent document 2, the water in the water supply plate is continuously supplied from a water feed pipe, and a level of the water in the water supply plate is kept in a prescribed level by overflowing.

In the paper sheet humidifying device described in the Patent document 1, the water level in a container is kept constant by the control of water supply system for supplying water to the container. In the case of Patent document 1, accuracy of water supply system for supplying water to the surface of water supply roller, in other words the accuracy of keeping the water level in the container, further, the accuracy of homogeneity of humidifying the paper sheet depend on accuracy of supplying water onto the water supply roller. Therefore in cases where the water supply system does not work correctly, the water level in the container varies, and consequently homogeneous humidification may not be performed due to the variation of humidifying amount of the paper sheet.

Further, foreign substances mixed into the water in the container increase as the humidification continues. The increased foreign substances are transferred to the water supply roller and further to the humidifying roller to cause uneven humidification or attachment the paper sheet with foreign substances.

According to the Patent document 2, the water level in the water supply plate is maintained constant by overflowing of the water, and the water level is kept constant with a high degree of accuracy.

Further, the water removed of foreign substances is always supplied to the water supply plate, and the water to be supplied is constantly replaced with the new one due to the overflowing. Thus, the problem of mixing-in with the foreign substances is prevented.

In this way, the paper sheet humidifying device of Patent document 2 is improved in some aspects compared to that of Patent document 1. However, it is revealed in the humidifying device of Patent document 2 that the water possibly flows out from a drain tank which accepts the water overflowed from the water supply plate.

In the paper sheet humidifying device of Patent document 2, the water in the drain tank is ejected through a drain pile to a water storage tank, thus during a proper movement the water never accumulates in the drain tank. However, in cases where the drain pipe clogs up with fragments of the paper sheet and the like, the water may flow out from the drain tank.

This type of problem never occurred in the paper sheet humidifying device of Patent document 1, since a water supply control is conducted to keep the water level in the container constant, and the water supply is stopped when the water level rises over a prescribed level. Therefore, the water level never exceeds the prescribed level, and the water is never caused overflowing.

SUMMARY OF THE INVENTION

Configurations reflecting at least one aspect of the present invention are as following items:

1. A paper sheet humidifying device including: a humidifying roller to convey a paper sheet and apply water to the paper sheet; a water supply roller to supply water to the humidifying roller; a water supply plate to contain the water for dipping the water supply roller, and to eject excessive water by overflowing; a water feeding section to feed the water to the water supply plate; a drain tank to receive the water ejected from the water supply plate, the drain tank comprising a drain outlet to eject the received water; a water level sensor to output a signal when a water level in the drain tank reaches a prescribed level; and a controller to execute a control to prevent overflowing of the water from the drain tank based on the signal from the water level sensor.

2. The paper sheet humidifying device described in item 1, wherein the controller stops a movement of the water feeding section based on the signal from the water level sensor.

3. The paper sheet humidifying device described in item 1 or 2, wherein the drain tank is further provided with an auxiliary drain outlet which is closed under a normal condition, and wherein the controller opens the auxiliary drain outlet based on the signal from the water level sensor and executes drainage of the water from the auxiliary drain outlet.

4. The paper sheet humidifying device described in any one of items 1 to 3, further provided with a drain pump to drain the water from the drain tank, wherein the controller activates the drain pump based on the signal from the water level sensor and forcibly drains the water from the drain tank.

5. A paper sheet post-processing apparatus provided with the paper sheet humidifying device described in any one of items 1 to 4.

6. The paper sheet post-processing apparatus described in item 5, further provided with: a first conveyance section to convey the paper sheet to the paper sheet humidifying device; a second conveyance section not to convey the paper sheet to the paper sheet humidifying device; and a switching gate to selectively guide the paper sheet to the first conveyance section or to the second conveyance section, wherein the controller controls the switching gate, based on the signal from the water level sensor, so as to switch a conveyance path of the paper sheet from the first conveyance section to the second conveyance section.

7. The paper sheet post-processing apparatus described in item 6, wherein the second conveyance section is provided with a decurling section to correct a curl of the paper sheet.

8. An image forming system including an image forming apparatus to form an image on the paper sheet, and the paper sheet humidifying device described in any of items 1 to 4.

BRIEF DESCRIPTION OF THE DRAWINGS

These and other objects, advantages and features of the invention will become apparent from the following description thereof taken in conjunction with the accompanying drawings in which.

DETAILED DESCRIPTION OF THE PREFERRED EMBODIMENT

Image Forming System

Figure 1:
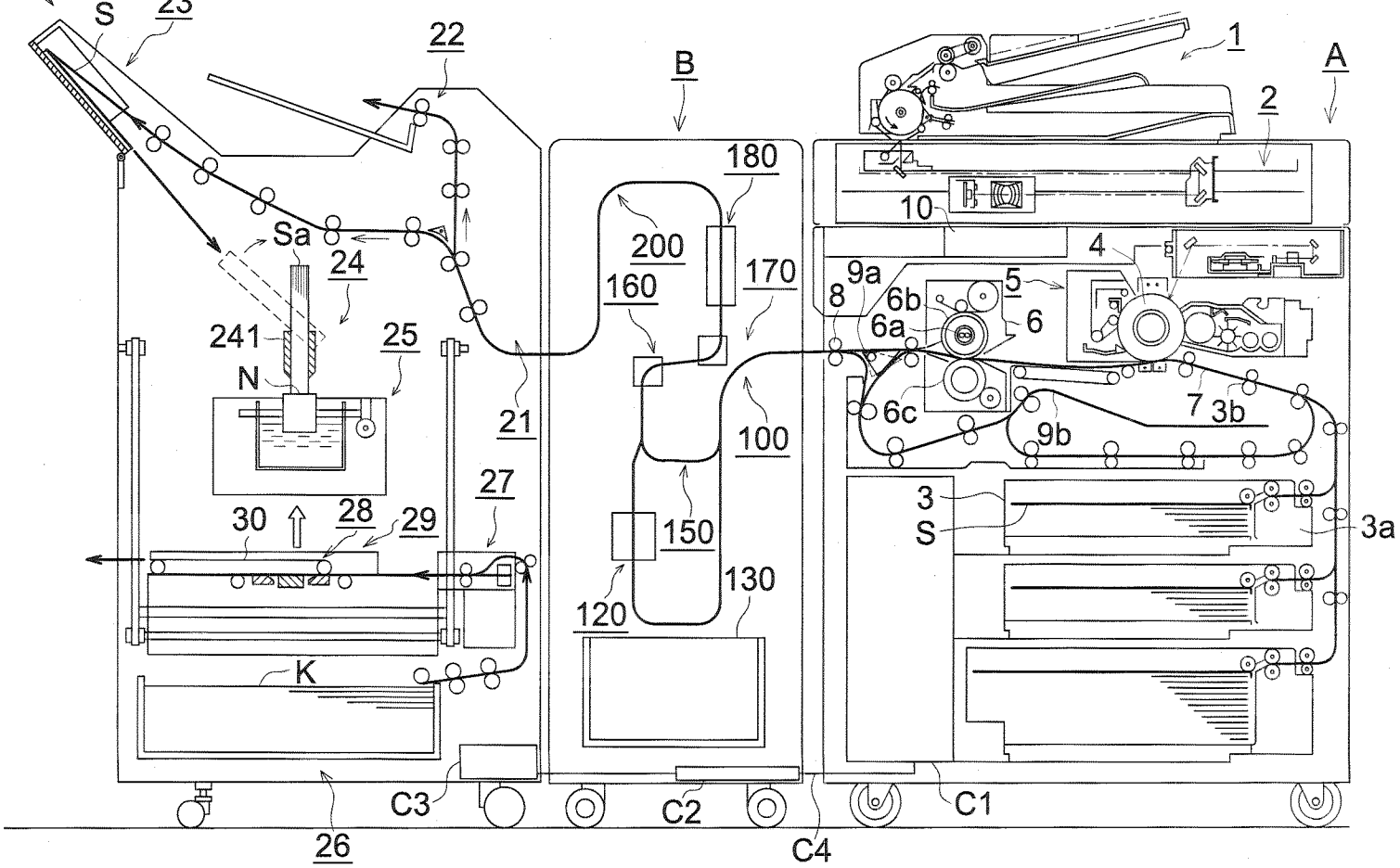
FIG. 1 illustrates an overall configuration of an image forming system relating to an embodiment of the present invention.

FIG. 1 is an overall drawing of the image forming system relating to the embodiment of the present invention. The image forming system is configured with an image forming apparatus A, a paper sheet post-processing apparatus B and a paper sheet post-processing apparatus FS.

The image forming apparatus A is configured with an automatic document feeder 1, an image reading section 2 at the upper portion, and a printer section at the lower portion.

In the printer section, sign 3 indicates a paper sheet containing section to contain the paper sheet S. In an image forming section (printer section) 5, which forms a toner image on a photosensitive member 4 through an electrophotographic process to execute charging, light exposing and developing onto the photosensitive member 4, images are formed on the paper sheet S. And the formed images are fixed at a fixing device 6. The fixing device 6 forms a nip portion to convey the sheet S between a heat roller 6*b* embedded with a heat source 6*a* and a pressure roller 6*c*, and fixes the images on the paper sheet S by heating and pressing to melt and fix the toner on the paper sheet while conveying the sheet S.

Paper sheet S is fed by the first paper supply section 3*a* from the paper sheet containing section 3, and after temporarily stopped at the second paper feed section 3*b*, further fed to form images on the paper sheet S. The paper sheet S on which image has been formed is ejected by a paper ejection roller 8 from the exit.

As a conveyance path of the paper sheet S, provided are a paper feed path 7 from a paper sheet containing section 3 to the image forming section 5, a conveyance path 9*a* from the image forming section 5 through the paper ejection roller 8 to the exit, and a back side conveyance path 9*b* for reversing conveyance.

As the image formation modes, there are a single side face-down ejection mode, a single side face-up ejection mode, and a double side mode. In the single side face-down ejection mode, the paper sheet S, on whose one side an image is formed, is conveyed through the fixing device 6, and after being reversed by reversing process, further conveyed by the paper ejection roller 8 to be ejected.

In the single side face-up ejection mode, the paper sheet S, on whose one side an image is formed, is conveyed through the conveyance path 9*a*, and ejected directly by being conveyed by the ejection roller 8.

In the double side mode, the paper sheet S, on whose one side an image is formed, having been conveyed through the fixing device 6, goes downward and proceeds to the back side conveyance path 9*b*, and is re-supplied to the paper feed path 7 after having been reversed.

On backside of the re-supplied paper sheet S, a backside image is formed at the image fanning section 5, the paper sheet S on which the backside image has been formed passes through the fixing device 6 and is conveyed by the ejection roller 8 to be ejected.

Sign 10 indicates an operation section, and settings of various modes in the image forming apparatus A and output mode utilizing the paper sheet post-processing apparatus FS are executed by operations on operation section 10.

Control unit C1 disposed in the image forming apparatus A is connected via communication section C4 to control unit C2 of a paper sheet post-processing apparatus and to control unit C3 of a paper sheet post-processing apparatus FS.

Paper sheet S ejected from the image forming apparatus A is conveyed through the paper sheet post-processing apparatus B to the paper sheet post-processing apparatus FS.

The paper sheet post-processing apparatus B is provided with a first conveyance section 100 to receive and convey the paper sheet S ejected from image forming apparatus A, a paper sheet humidifying device 120 to apply water onto the paper sheet S, a second conveyance section 150 to receive and convey the paper sheet S ejected from the image forming apparatus A, a first decurler 160, a second decurler 170, a third decurler 180, and an ejection paper conveyance section 200 to eject the paper sheet S and transfers to the paper sheet post-processing apparatus FS.

The paper sheet post-processing apparatus FS executes various post-processing to the paper sheet S ejected from image forming apparatus A. The illustrated paper sheet post-processing apparatus FS executes a book binding. The paper sheet post-processing apparatus FS may have a punching/folding device, a side stitching device, saddle stitching device, cutting device and the like.

As an embodiment of the paper sheet post-processing apparatus FS, a book binding (glue binding) apparatus will be described below.

The book binding apparatus is provided with a paper sheet introduction section 21, a sheet ejection section 21, a paper sheet bundle containing section 23, a paper sheet bundle conveyance section 24, a glue coating section 25, a cover sheet supply section 26, a cover sheet cutting section 27, a cover sheet casing section (case binding section) 28 and an alignment section 29.

Paper sheet S introduced into the paper sheet introduction section 21 is sequentially conveyed obliquely downward after loaded on the paper sheet bundle containing section 23, and gripped by the grip section 241 of the paper sheet bundle conveyance section 24. The grip section 241 rotates and stops at a prescribed position while gripping a bundle of paper sheet such that the side to be glued (spine) in the bundle of paper sheet Sa comes to downside. A glue coating section 25 coats the glue on the spine of paper sheet bundle Sa.

Cover sheet K contained in a cover sheet supply section 26, after being conveyed to a cover sheet casing section 28 via cover sheet cutting section 27, is cut at the back end to be prescribed length by the cover sheet cutting section 27. Cutting length of the cover sheet K is two-sheet length of the paper sheet S in the proceeding direction added with the thickness of the spine of the paper sheet bundle S.

The cover sheet casing section 28 receives and conveys the cover sheet K supplied from cover sheet supply section 26 and stops at a prescribed position, after that, an alignment section 29 align the position of the cover sheet K in the width direction. The cover sheet casing section 28 presses the cover sheet K to glue coated surface N of the paper sheet bundle Sa to adhere.

By the moving down of a pressing member facing to the spine of paper sheet bundle Sa, and the movement of a pair of symmetrical bending members arranged above the cover sheet casing section 28, the cover sheet K is bent along side edges of the glue coated surface of paper sheet bundle Sa, thus, the paper sheet bundle Sa cased with cover sheet K on both front and back side of the bundle Sa is formed.

After completing the bending process of the cover sheet K, the cover sheet casing section 28 moves down and evacuates, after that, along with the evacuation of the alignment section 29, the ejection belt 30 which has evacuated outside of cover sheet K in the width direction moves to inside the width direction under the cover sheet K and stops. After that, when gripping by the grip section 241 is released, the paper sheet bundle Sa moves down and stops at the position where the spine in the down side of paper sheet bundle Sa contacts to the upper surface of ejection belt 30. Turning ejection belt 30 ejects the booklet formed with case binding process of gluing the cover sheet K on the paper sheet bundle Sa.

<Paper Sheet Post-Processing Apparatus>

Figure 2:
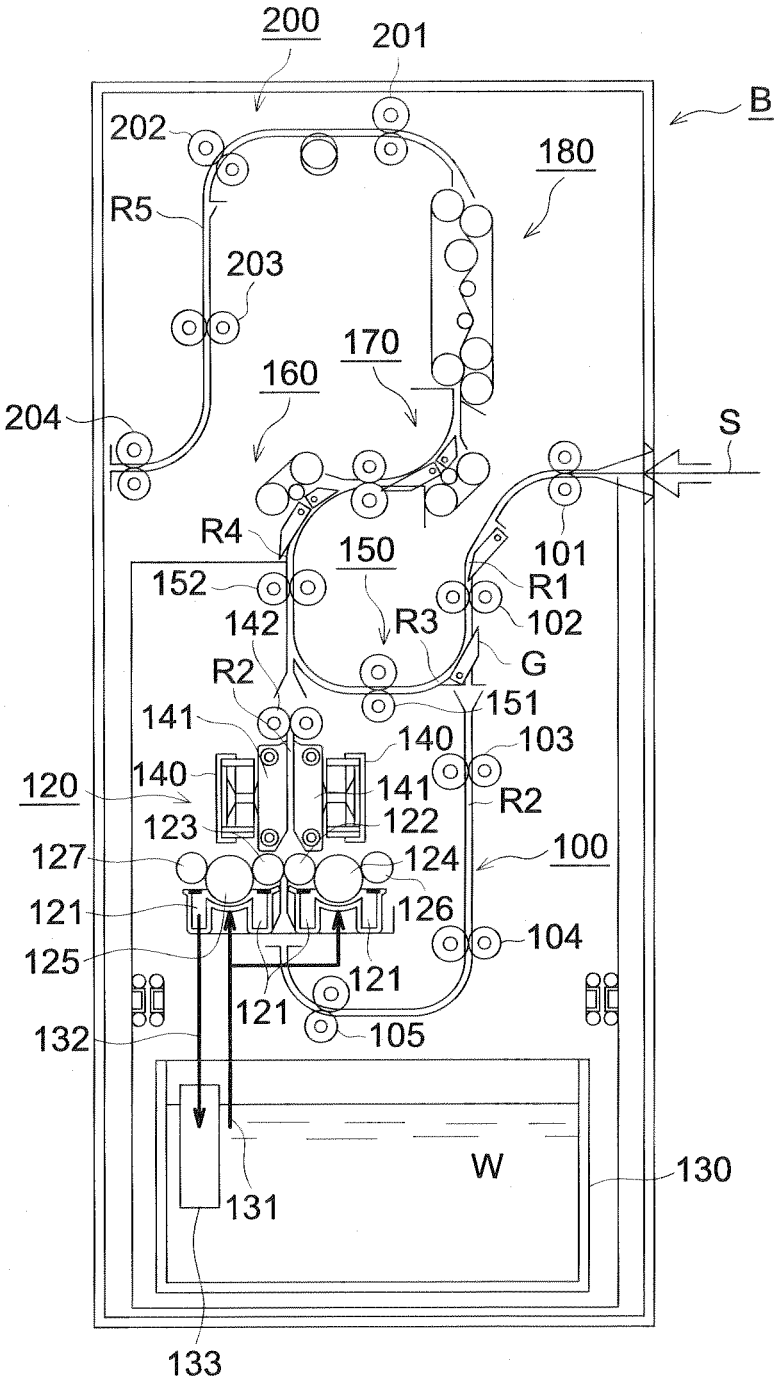
FIG. 2 illustrates an overall configuration of paper sheet post-processing apparatus B relating to an embodiment of the present invention.

FIG. 2 is a drawing showing the overall configuration of paper sheet post-processing apparatus B relating to an embodiment of the present invention.

First conveyance section 100 is provided with conveyance path R1, paper sheet humidifying device 120 is provide with conveyance path R2, second conveyance section 150 is provide with conveyance path R3, first to third decurlers 160, 170 and 180 are provide with conveyance path R4, and ejection paper conveyance section 200 is provide with conveyance path R5.

Conveyance paths R1-R5 are formed with a plurality of guide members as shown in the drawing.

A part of conveyance path R1 is commonly utilized by the first and second conveyance sections 100 and 150.

By a switching function of the switch gate G, the paper sheet S conveyed into the paper sheet post-processing apparatus B is conveyed from the first conveyance section 100 via the second conveyance section 150, and the decurling section including the first to third decurlers 160, 170, and 180, and is ejected by the ejection paper conveyance section 200, or the paper sheet S is conveyed from the first conveyance section 100 to the paper sheet humidifying apparatus 120, and from the paper sheet humidifying apparatus 120, conveyed via the second conveyance section 150, the first to third decurlers 160, 170, and 180, and is ejected by the ejection paper conveyance section 200.

In the first conveyance section 100, the paper sheet S is conveyed by the conveyance rollers 101-105 into the paper sheet humidifying apparatus 120.

In the paper sheet humidifying apparatus 120, the paper sheet S is conveyed by the humidifying rollers 122 and 123, and conveyance rolled 42.

In the second conveyance section 150, the paper sheet S is conveyed by the conveyance rollers 151 and 152.

In the ejection paper conveyance section 200, the paper sheet S is conveyed by the conveyance rollers 201-204, and ejected.

Figure 3:
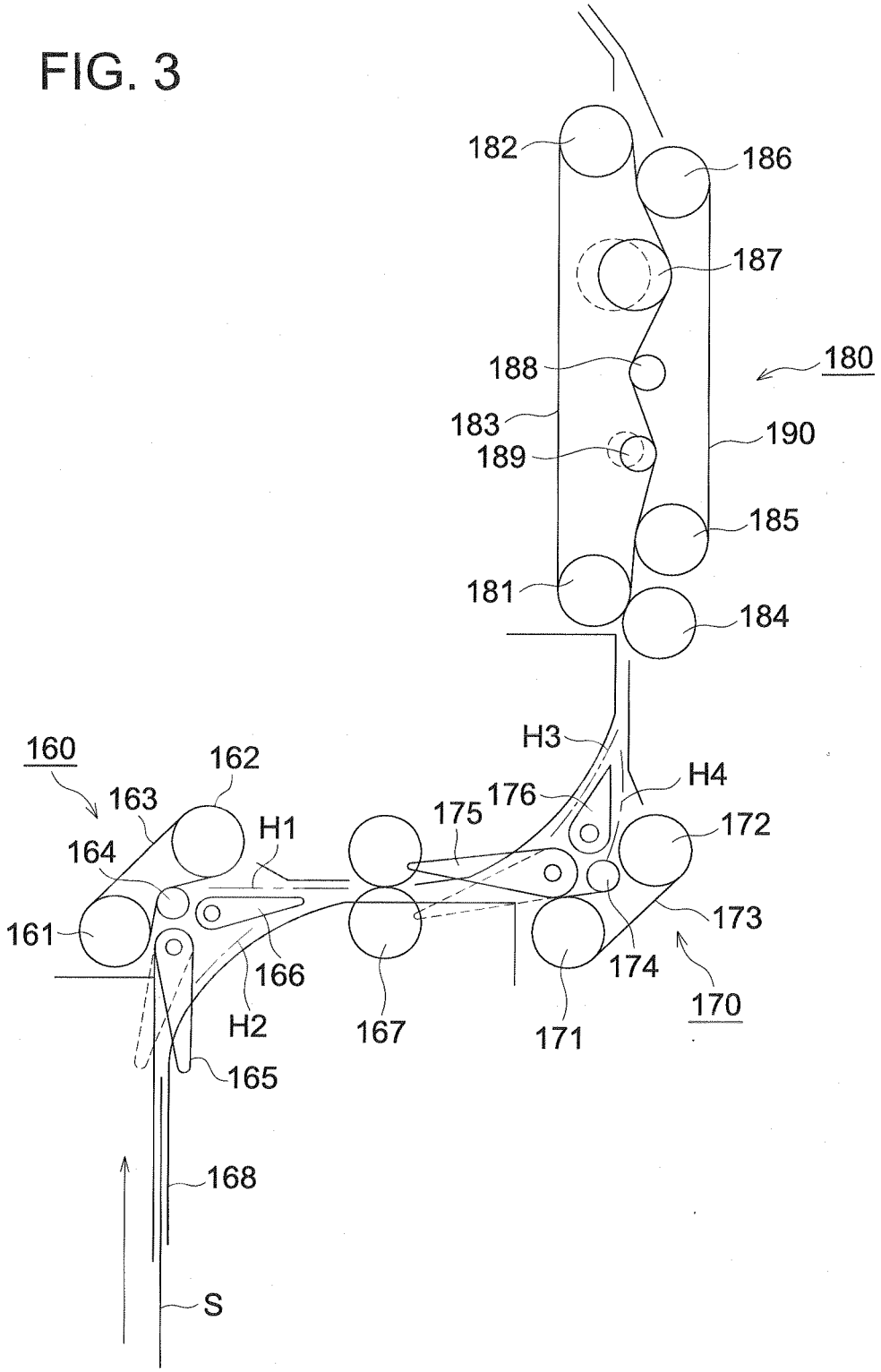
FIG. 3 illustrates a configuration of a decurling device.

Referring to FIG. 3, decurling section will described.

The decurling section is provided with the first decurler 160, the second decurler 170, and the third decurler 180.

In the first decurler 160, belt 163 is extended around a pair of rollers 161 and 162, and pressure roller 164 contacts the belt 163.

As shown in FIG. 3, the pressure roller 164 presses the belt 163 at an intermediate position between the rollers 161 and 162 to bend the belt 163.

As a result, conveyance path H1 to bend the paper sheet S toward right direction is formed with the rollers 161 and 162, the belt 163, and the pressure roller 164.

Sign 165 indicates a switching gate to switch the guide to conveyance path H1 or H2, that guides the paper sheet S to the conveyance path H1 when located at the solid line position, and guides the paper sheet S to the conveyance path H2 when located at the dashed line position.

Paper sheet S guided into the conveyance path H1 is corrected of a curl, by being bent with the rollers 161 and 162, the belt 163, and the pressure roller 164.

Since the paper sheet S guided to the conveyance path H2 is conveyed in the conveyance path H2 having a loose curvature, the curl of this sheet is not corrected.

From the first decurler 160, the paper sheet S is conveyed by the conveyance roller 167 and conveyed to the second decurler 170.

In the second decurler 170, a belt 173 is extended around a pair of rollers 171 and 172, and a pressure roller 174 contacts the belt 173.

As shown in FIG. 3, the pressure roller 174 presses the belt 173 at an intermediate position between the rollers 171 and 172 to bend the belt 163.

As the result, conveyance path H4 to bend the paper sheet S toward left direction is formed with the rollers 171 and 172, the belt 173, and the pressure roller 174.

Sign 175 indicates a switching gate to switch the guide to conveyance path H3 or H4, that guides the paper sheet S to the conveyance path H4 when located at the solid line position, and guides the paper sheet S to the conveyance path H3 when located at the dashed line position.

Paper sheet S guided into the conveyance path H4 is corrected of a curl, by being bent with the rollers 171 and 172, the belt 173, and the pressure roller 174.

Since the paper sheet S guided to the conveyance path H3 is conveyed in the conveyance path H3 having a loose curvature, the curl of this sheet is not corrected.

In a third decurler 180, a belt 183 is extended around rollers 181, 182, 187 and 189, while a belt 190 is extended around rollers 185, 186, and 188.

As shown in FIG. 3, rollers 181, 182, and 185-189 are arranged to make the belts 183 and 190 meandering.

The belts 183 and 190 contacts with each other, and at the contact point, grip the paper sheet S to convey. 184 is a conveyance roller to introduce the paper sheet S into the decurler 180.

The rollers 187 and 189 extend the belt 183, namely they contact the inner periphery face of the belt 183 and press the belt 190 from its outer periphery side.

The rollers 188 extends the belt 190, namely the roller 188 contacts the inner periphery face of the belt 190 and press the belt 183 from its outer periphery side.

The rollers 187 and 189 are respectively capable of displacement to the solid line positions and to the dashed line positions.

When located at the solid line positions, the rollers 187 and 189 correct the curl of the paper sheet S by bending toward left direction, and when located at the dashed line positions do not conduct the curl correction.

Further, the roller 188 corrects the curl of the paper sheet S by bending toward right direction when rollers 187 and 189 are located at the solid line positions.

The third decurler 180 correct a miner curl of the paper sheet S.

Namely, at the first decurler 160 and the second decurler 170, measure curls are corrected, and at the third decurler 180 remained minor curls are corrected.

By controlling the positions of the switching gates 165 & 175, and the rollers 187 & 189, according to types of the paper sheet S for example, the curl correction of the paper sheet S can be properly conducted.

<Paper Sheet Humidifying Device>

Figure 4:
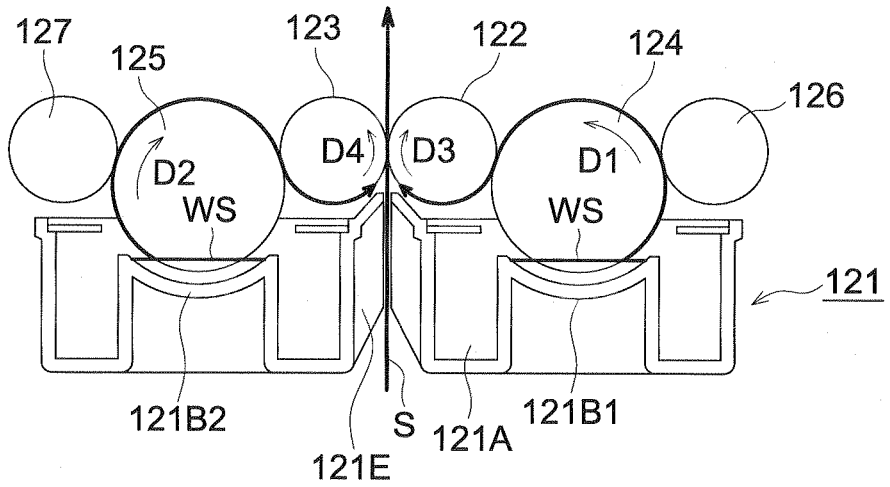
FIG. 4 illustrates a configuration of a paper sheet humidifying device.
Figure 5:
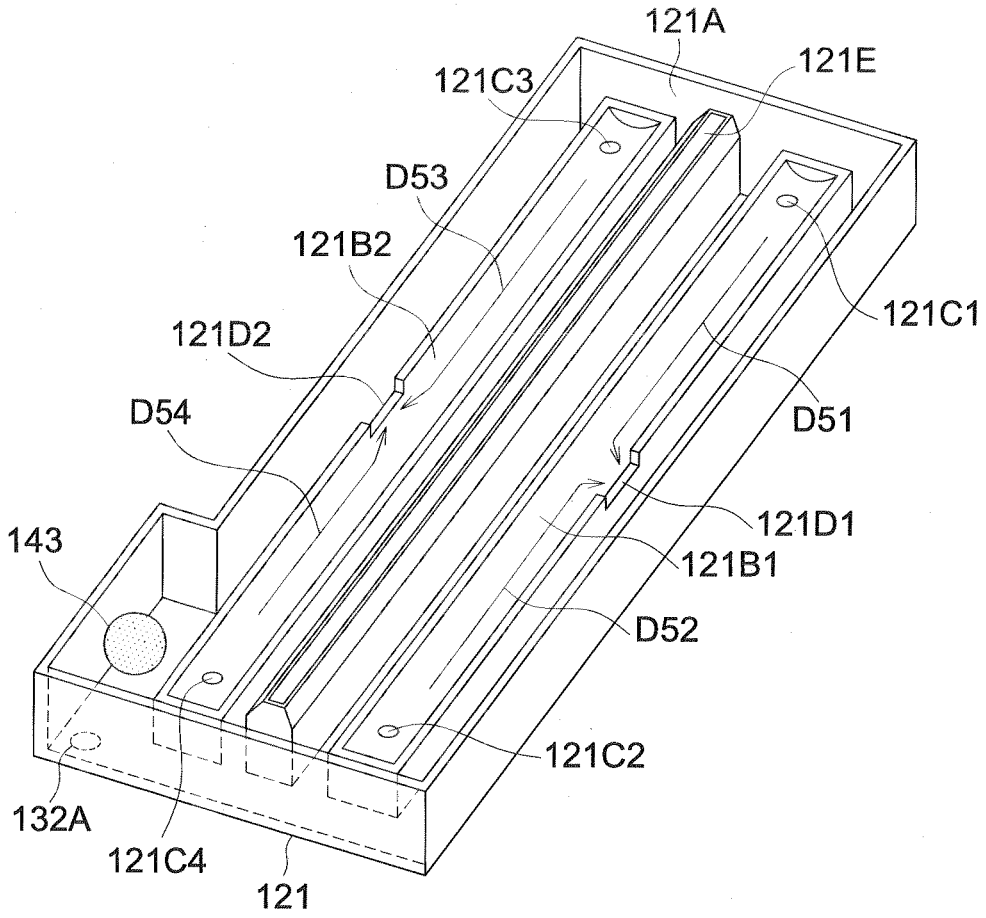
FIG. 5 illustrates a perspective view of a water trough.
Figure 6:
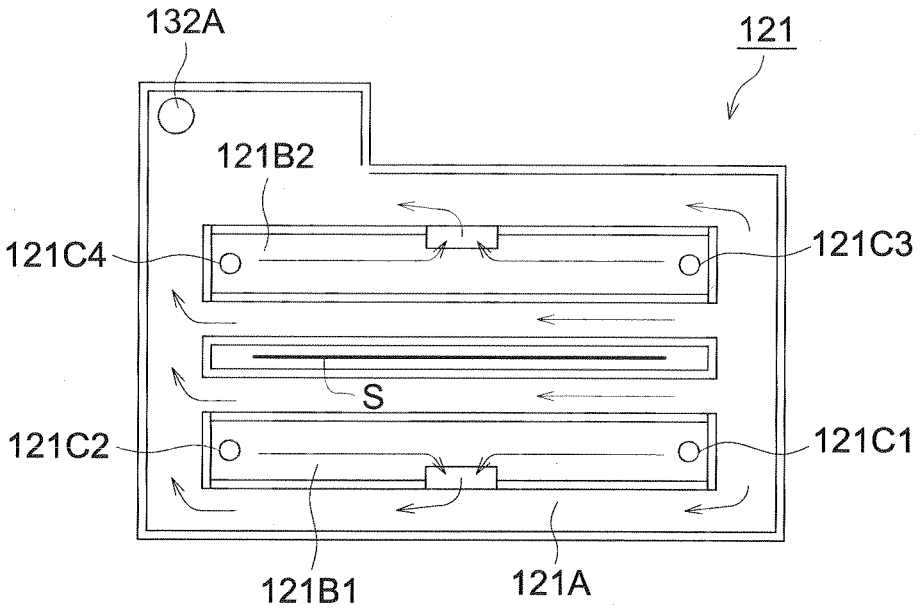
FIG. 6 illustrates a plan view of a water trough.
Figure 7:
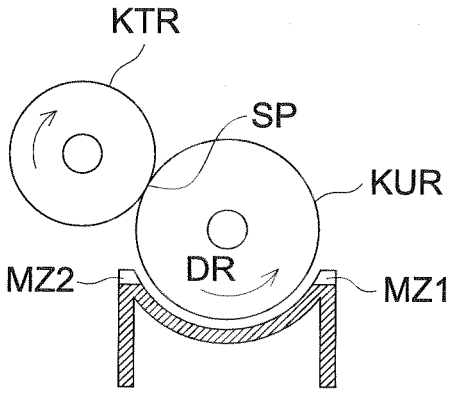
FIG. 7 illustrates a section view of a humidifying roller, water supply roller, and a water supply plate.
Figure 8:
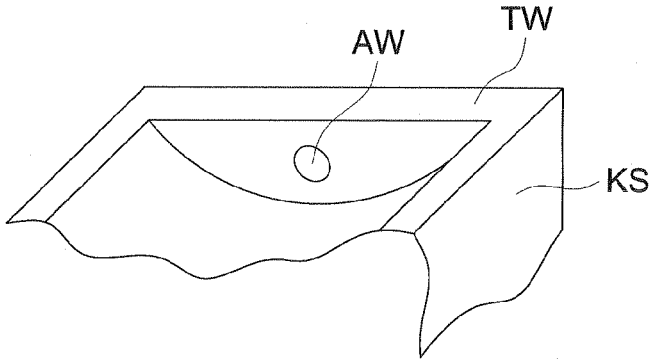
FIG. 8 illustrates a perspective view at end portion of a variant water supply plate.

Referring to FIGS. 2, and 4-8, paper sheet humidifying device 120 will be described in structures and functions. FIG. 4 is a drawing to show the configuration of the paper sheet humidifying device, FIG. 5 is a perspective view of a water trough, FIG. 6 is a plan view of the water trough, FIG. 7 is a section view of a humidifying roller, a water supply roller, and a water supply plate, and FIG. 8 is a perspective view at end portion of a variant water supply plate.

A water trough 121 to contain water for humidifying the paper sheet forms a drain tank 121A that is a little longer than the maximum width (length in the direction perpendicular to the conveyance direction) of the conveyed paper sheet S.

In the water trough 121, water supply plates 121B1 and 121B2 are arranged side by side.

The water supply plates 121B1 and 121B2 respectively form rooms to contain the water at higher positions than the drain tank 121A formed in the water trough 121.

As will be described later, the water contained in the water supply plates 121B1 and 121B2 overflows and goes down to the drain tank 121A.

At the center part of the water trough 121, a gap 121E is formed where the paper sheet S passes through.

As shown in FIG. 5, the water supply plates 121B1 and 121B2 and the water trough 121 are formed like islands in the drain tank 121A.

Each of the water supply plates 121B1 and 121B2 has an inner peripheral surface of circular arc corresponding respectively to outer peripheral cylindrical surface of the water supply rollers 124 and 125.

As will be described later, in the water supply plates 121B1 and 121B2 the water is supplied from the water feed pipe 131, and a constant water level is kept by overflowing from drain ditches 121D1 and 121D2.

Above the water supply plates 121B1 and 121B2, water supply rollers 124 and 125 are respectively arranged at prescribed distances from the inner peripheral surfaces of the water supply plates 121B1 and 121B2. Lower parts of water supply rollers 124 and 125 are dipped in the water contained in the water supply plates 121B1 and 121B2.

The water supply rollers 124 and 125 are structured with gum rollers formed of gum layers on metal center cores. The water supply roller 124 rotates in the arrow direction D1 and the water supply roller 125 rotates in the arrow direction D2.

A humidifying roller 122 is arranged so as to contact the water supply roller 124, a humidifying roller 123 is arranged so as to contact the water supply roller 125, and the humidifying rollers 122 and 123 contact with each other.

The humidifying rollers 122 and 123 are structured with gum rollers formed of gum layers on metal center cores. The humidifying roller 122 rotates in the arrow direction D3 and the humidifying roller 123 rotates in the arrow direction D4. The peripheral surface of the humidifying roller 122 and the peripheral surface of the humidifying roller 123 move in the same upward direction at the contact position, and grip and convey the paper sheet S.

Any one of the humidifying rollers 122 and 123 is driven to rotate by a drive source (not illustrated) and, as a drive roller, chives to rotate the other humidifying roller and the water supply rollers 124 and 125.

126 indicates a regulation member to contact the water supply roller 124, and 127 indicates a regulation member to contact the water supply roller 125.

The regulation members 126 and 127 are configured with cylindrical metal bodies, and rotate by respectively driven by the water supply rollers 124 and 125.

130 indicates a water storage tank, 131 indicates a water feed pipe, 132 indicates a drain pipe, and 133 indicates a filter.

By a water feed pump (not illustrated) structuring a water feeding section, the water W is supplied from the water storage tank, through the water feed pipe 131 to the water supply plates 121B1 and 121B2, and through the drain pipe 132 flow back to the water storage tank 130 from the water trough 121.

Foreign substances mixed into the water W in the process of applying the water to the paper sheet, such as paper dusts are filtered with the filter 133. The water W circulates between the water storage tank 130 and the water through 121.

Applying the water to the paper sheet S is conducted as described below.

Paper sheet S conveyed by the conveyance roller 105 to the paper sheet humidifying device 120 passes the gap 121E and is further conveyed by the humidifying rollers 122 and 123.

On the outer peripheral surfaces of the humidifying rollers 122 and 123, the water W is supplied from the water trough via water supply rollers 124 and 125, and the paper sheet S is continuously applied water in the course of conveyance.

On the outer peripheral surfaces of the water supply rollers 124 and 125, uniform water layers are formed, and the water layers are made further uniform by the regulation members 126 and 127.

Although in the process of applying water to the paper sheet, foreign substances from the paper sheet such as paper dusts attach on the humidifying rollers 122 and 123 and are mixed in the water W, the foreign substances mixed in the water W are filtered by the filter 133.

In FIGS. 5 and 6, arrow marks indicate the flow of water W in the water supply plates 121B1 and 121B2, and the drain tank 121A.

In the water supply plate 121B1, water feed inlets 121C1 and 121C2 are provided at both end portions in the conveyance width direction (perpendicular to the conveyance direction). In the water supply plate 121B2, water feed inlets 121C3 and 121C4 are provided at both end portions in the conveyance width direction.

The water feed inlets 121C1-121C4 are preferably provided outside positions of maximum width of the paper sheet to be conveyed.

Inside the water feed inlets 121C1-121C4 with respect to the conveyance width direction, preferable water flows are formed, accordingly, by the above described arrangement of the water feed inlets the attachment of foreign substances to the water supply rollers 124 and 125 is inhibited.

The water feed inlets 121C1-121C4 are formed at the upper end portions of the water feed pipe 131 in FIG. 2.

At the intermediate portion of the wall between the drain tank 121A and the water supply plate 121B1, the drain ditch 121D1 is formed, and at the intermediate portion of the wall between the drain tank 121A and the water supply plate 121B2, the drain ditch 121D2 is formed.

As described above, each of the water supply plates 121B1 and 121B2 has an inner peripheral surface of circular arc corresponding respectively to outer peripheral cylindrical surface of the water supply rollers 124 and 125.

At the intermediate portion in the conveyance width direction on the walls forming edge portions of the water supply plates 121B1 and 121B2, arranged are the drain ditches 121D1 and 121D2.

Depth of the water supply plates 121B1 and 121B2 is approximately 6 mm, and gaps between the drain ditches 121D1 & 121D2 and upper edges of walls of the water supply plates 121B1 & 121B2 are approximately 2 to 3 mm.

According to the above-described structure of the water supply plates 121B1 and 121B2, the water fed from the water feed inlets 121C1-121C4 flows toward the center portion as shown by the arrow marks D51-D54, overflows from the drain ditches 121D1 and 121D2, and falls into the drain tank 121A.

The fallen water is drained from the drain outlet 132A to the drain pipe 132.

If the drain ditches 121D1 and 121D2 are not provided, the position is not specified where the water falls from the water supply plates 121B1 and 121B2 into the drain tank 121A, and the flow path in the water supply plates 121B1 and 121B2 becomes irregular.

Accordingly, the foreign substances, mixed into the water in the course of applying the water to the paper sheet, attach onto various portion of the water supply plates 121B1 and 121B2, as the result, flaws occurs such that the water layers formed on the water supply rollers 122 and 123 become nonuniform.

By providing the drain ditches 121D1 and 121D2, the water flow paths in the water supply plates 121B1 and 121B2 become uniform, the foreign substances do not adhere onto the water supply plates 121B1 and 121B2, fall into the drain tank 121A, drained via the drain pipe 132 and are collected by the filter 133.

Considering installation conditions of the paper sheet post-processing apparatus B, positions of the drain ditches 121D1 and 121D2 are preferably arranged at the central part in the conveyance width direction.

By arranging the drain ditches 121D1 and 121D2 at the central part, even in cases where the paper sheet post-processing apparatus B is installed on a slant to some extent, the drain ditches 121D1 and 121D2 tend to work properly. Further the level of water contained in the water supply plates 121B1 and 121B2 does not largely change, and uniform water application can be ensured.

In the example illustrated in the figures, the drain ditch 121D1 is arranged at upstream side of the position where the water supply roller 124 transfers the water to the humidifying roller 122, namely the position where the water supply roller 124 touches the humidifying roller 122, in the rotational direction D1 of the water supply roller 124.

By this arrangement of the drain ditch 121D1, the flow path of the water W and the foreign substances is specified, during the rotation of the water supply roller 124. By this, the foreign substances transferred from the humidifying roller 122 to the water supply roller 124 are effectively drained from the drain ditch 121D1. Further, the water paths indicated by the arrow marks D51-D54 are formed to smoothly flow the water W.

The drain ditch 121D2 is similarly arranged. The drain ditch 121D2 is arranged at upstream side of the position where the water supply roller 125 touches the humidifying roller 123, in the rotational direction D2 of the water supply roller 125.

Instead of providing the drain ditches 121D1 and 121D2, or in addition to providing the drain ditches 121D1 and 121D2, the drain ditches may be provided at downstream side in the rotational direction of the water supply rollers 124 and 125.

FIG. 7 shows the example of arranging a downstream side drain ditch MZ2 and an upstream side drain ditch MZ1.

On both sides of the water supply roller, the downstream side drain ditch MZ2 and the upstream side drain ditch MZ1 are provided.

Similarly to the above described drain ditches 121D1 and 121D2, the upstream side drain ditch MZ1 is arranged at upstream side in the rotational direction of water supply roller KUR with respect to the contact position of humidifying roller KTR and the water supply roller KUR. The downstream side drain ditch MZ2 is arranged at downstream side in the rotational direction of water supply roller KUR with respect to the contact position of humidifying roller KTR and the water supply roller KUR.

Since being arranged on ahead a flow formed by rotation of the water supply roller KUR, the upstream side drain ditch MZ1 makes the circulation of the water smooth in the water supply plate, as a result, forms a uniform water layer on the water supply roller KUR.

The downstream side drain ditch MZ2 makes the flow of water W smooth, and effectively collects and ejects the foreign substances carried by the water supply roller KUR since it is arranged at near side of the contact position of the water supply roller KUR and the humidifying roller KTR.

Although, in the example shown in the figures, the water feed inlets 121C1-121C4 are arranged at the bottom part of the water supply plates 121B1 and 121B2, a water feed inlet AW can be arranged at a side wall TW of water supply plate KS on end portion of conveyance width direction.

Paper sheet S is guided by a pair of guide members 141, and conveyed upward.

At the position where the paper sheet is guided by the guide members, excessive water is removed for humidity conditioning by a pair of fans 140 from both sides of the paper sheet S.

<Prevention of Water Overflowing from Drain Tank>

Figure 9:
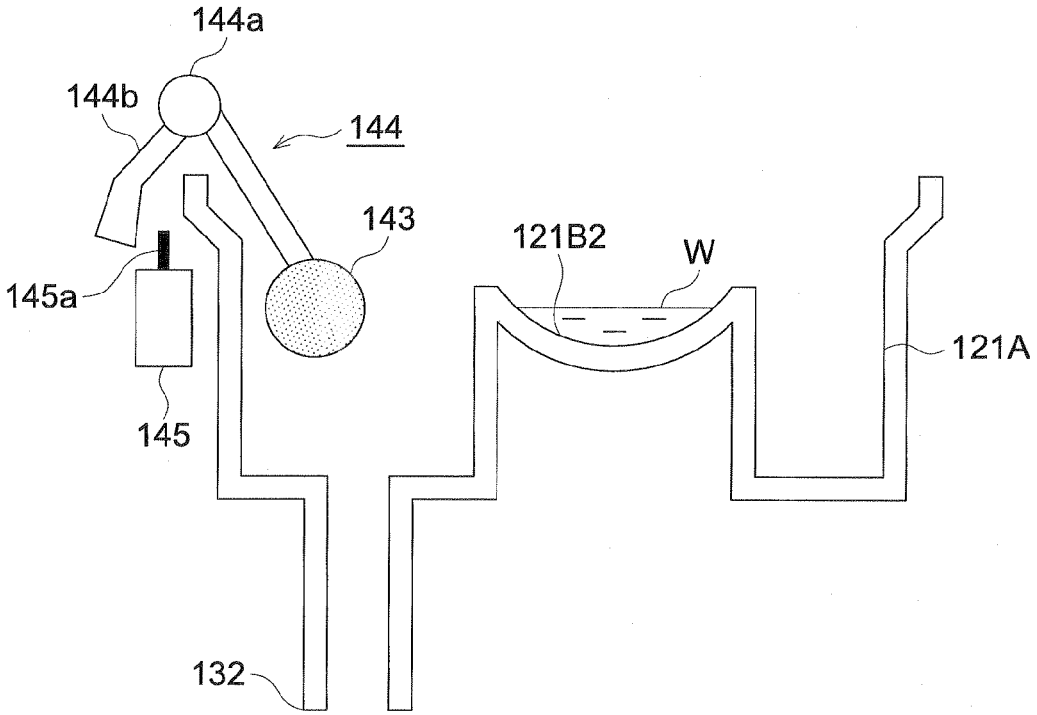
FIG. 9 illustrates a water level sensor to detect a water level in a drain tank.

The paper sheet humidifying apparatus 120 has a prevention mechanism to prevent an accident of water-overflowing from the drain tank 121A. Referring to FIGS. 2, 4 and 9, the prevention mechanism will be described below.

Figure 10:
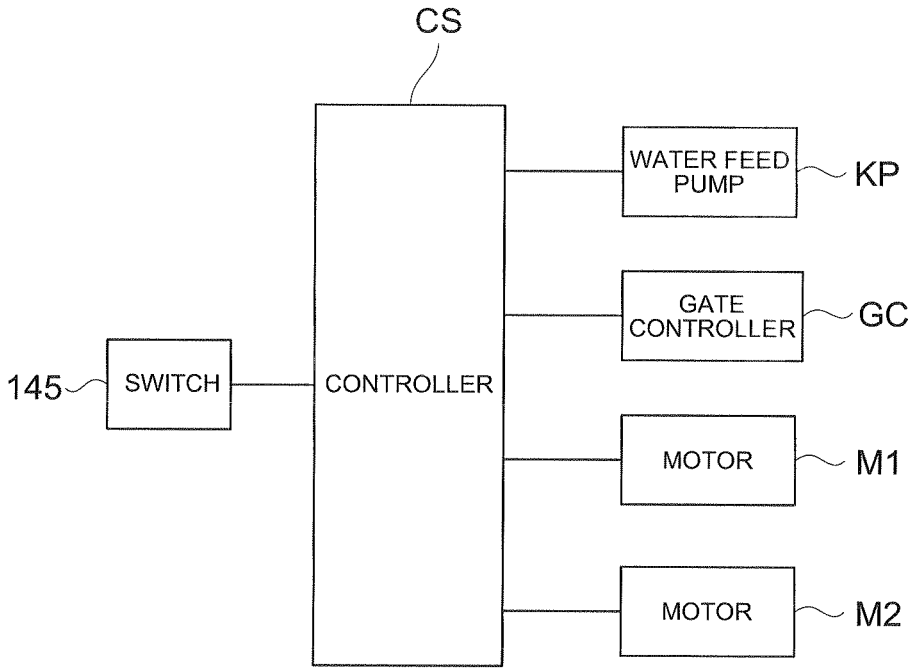
FIG. 10 illustrates a block diagram of a control system to prevent flowing-out of the water.

FIG. 9 shows a water level sensor to detect the water level in the drain tank 121A having reached a prescribed level. FIG. 10 shows a block diagram of a control system for the prevention mechanism of water-overflowing.

As shown in FIG. 5, a float 143 is provided near the portion where the drain outlet 121A is arranged in the drain tank 121A.

The float 143 is fixed at an end of support arm 144. At the other end of the support arm 144, an actuator 144*b* is provided. The support arm 144 is rotatable about an axis 144*a* as a rotation center.

By the movement of actuator 145*a* of a switch 145 caused by being pushed by the actuator 144*b*, the switch 145 switches to ON from OFF state. The float 143, the support arm 144, and the switch 145 constitute the water level sensor to detect the water level in the drain tank 121A having reached a prescribed level.

While the paper sheet humidifying device 120 works properly, the water having flown out from the water supply plate 121B1 does not remain in the drain tank 121A, but is drained through the drain pipe 132. However, in cases where the drain pipe is clogged with foreign substances, the water W remains in the drain tank 121A.

When the water level in the drain tank 121A has reached the prescribed level, namely when has reached near the upper edge of the drain tank 121A, the float 143 is pushed up by the water W to rotate the support aim 144 counterclockwise. The rotation of the support arm 144 is detected by the switch 145.

In the humidifying process, fibers or fillers separated from the paper sheet are mixed in the water W as the foreign substances. However, these foreign substances mixed in the water W during the properly operating usual humidifying process do not make the drain pipe 132 clogged. These foreign substances are removed by being filtered with the filter 133 (refer to FIG. 2). Thus, the water without containing the foreign substances is fed to the water supply plates 121B1 and 121B2.

In cases where a paper is jammed in the paper sheet post-processing apparatus B (refer to FIG. 2), the paper sheet post-processing apparatus B may stop in a state that a paper sheet remains in the paper sheet humidifying device 120. In cases where the paper sheet remains, the paper sheet may stick to the humidifying roller 122 and 123. While the paper sheet humidifying device 120 works, the stuck paper sheet drops into the drain tank 121A, being ejected with the water to the drain pipe 132, and clogs the drain pipe 132.

The overflowing detection using the float 143 is to prevent the accident that occurs in other cases than the above described normal operation.

In FIG. 10, CS is a controller to execute the prevention control of water overflowing. KP is a water feed pump to feed the water through the water feed pipe 131 to the water supply plates 121B1 and 121B2. GC is a gate controller to drive a switch gate G that selectively guide the paper sheet S to the first conveyance section 100 or to the second conveyance section 150. M1 is a motor to execute pressing and releasing between the humidifying roller 122 and the humidifying roller 123, pressing and releasing between the humidifying roller 122 and the water supply roller 124, and pressing and releasing between the humidifying roller 123 and the water supply roller 125. M2 is a motor to drive the rotation of humidifying rollers 122 and 123. The controller CS is configured with control sections C1 and C2. The water feed pump KP configures the water feeding section to feed the water to the water supply plates 121B1 and 121B2.

Upon receiving an ON signal of the switch 145, the controller CS stops the water feed pump KP to stop water feeding to the water supply plates 121B1 and 121B2. Concurrently to stopping the water feeding, the controller CS controls the gate controller GC to activate the switch gate G to switch the paper sheet conveyance from the first conveyance section 100 to the second conveyance section 150. Further, the controller CS controls to release the pressure contacts between the humidifying rollers 122 and 123, the humidifying roller 122 and the water supply roller 124, and between the humidifying roller 123 and the water supply roller 125, as well as controlling the motor M2 to stop the rotation of paper sheet humidifying rollers 122 and 123.

According to these controls, when the water level in the drain tank 121A reaches the prescribed level, the water supply to water supply plates 121B1 and 121B2 is stopped, and the paper conveyance path is switched from a paper feeding path for the paper sheet humidifying device to another paper feeding path for the first decurler 160.

By this paper conveyance path switching, the paper sheet processing of executing the curl correcting process by the first to third decurlers 160-180 after the humidifying process by the paper sheet humidifying device 120 is switched to the paper sheet processing of only the curl correcting process by the first to third decurlers 160-180.

The humidifying process by the paper sheet humidifying device 120 ensures the effect of curl correcting process by the decurlers 160-180. In cases where the overflowing of water occurs, by the curl correcting process without the humidifying process, degradation of the paper sheet by curling and problems on the paper sheet conveyance can be suppressed to a respectable degree.

As the control of the water-overflowing prevention mechanism, other control methods to be described below are capable, other than the method of stopping the water feed pump KP.

The other control methods are:

To warn the water overflowing by sound or light;

To provide auxiliary drain pipe other than the usually used drain pipe 132 in the drain tank 121A. In this case, the auxiliary drain pipe is closed in normal humidifying process and is opened in the case of switch 145 being ON to drain the water through the auxiliary drain pipe; and To provide a drain pump, and activate the drain pump in the case of switch 145 being ON to forcibly drain the water.

Drainage through the auxiliary drain pipe or the forcible drainage by the drain pump may be utilized together with the formerly describe water feeding stop and conveyance path switching, further, combination of these three control method may be applicable.

What is claimed is:

1. A paper sheet post-processing apparatus comprising:

a paper sheet humidifying device, wherein the paper sheet humidifying device comprises:

a humidifying roller to convey a paper sheet and apply water to the paper sheet;

a water supply roller to supply water to the humidifying roller;

a water supply plate to contain the water for dipping the water supply roller, and to eject excessive water by overflowing;

a water feeding section to feed the water to the water supply plate;

a drain tank to receive the water ejected from the water supply plate, the drain tank comprising a drain outlet to eject the received water;

a water level sensor to output a signal when a water level in the drain tank reaches a prescribed level; and a controller to execute a control to prevent overflowing of the water from the drain tank based on the signal from the water level sensor; and wherein the paper sheet post-processing apparatus further comprises:

a first conveyance section to convey the paper sheet to the paper sheet humidifying device;

a second conveyance section not to convey the paper sheet to the paper sheet humidifying device; and a switching gate to selectively guide the paper sheet to the first conveyance section or to the second conveyance section, wherein the controller controls the switching gate, based on the signal from the water level sensor, so as to switch a conveyance path of the paper sheet from the first conveyance section to the second conveyance section.

2. The paper sheet post-processing apparatus of claim 1, wherein the controller stops a movement of the water feeding section based on the signal from the water level sensor.

3. The paper sheet post-processing apparatus of claim 1, wherein the drain tank further comprises an auxiliary drain outlet which is closed under a normal condition, and wherein the controller opens the auxiliary drain outlet based on the signal from the water level sensor and drains the water through the auxiliary drain outlet.

4. The paper sheet post-processing apparatus of claim 1, further comprising a drain pump to drain the water from the drain tank, wherein the controller activates the drain pump based on the signal from the water level sensor and forcibly drains the water from the drain tank.

5. The paper sheet post-processing apparatus of claim 1, wherein the second conveyance section comprises a decurling section to correct a curl of the paper sheet.

6. An image forming system comprising:

an image forming apparatus to form an image on the paper sheet, and the paper sheet post-processing apparatus of claim 1.

* * * * *